United States Patent [19]

Capo

[11] 4,173,655

[45] Nov. 6, 1979

[54] POULTRY TRAY

[75] Inventor: James L. Capo, Franklin, Ohio

[73] Assignee: International Paper Company, New York, N.Y.

[21] Appl. No.: 913,802

[22] Filed: Jun. 8, 1978

[51] Int. Cl.[2] ..... B65D 85/54

[52] U.S. Cl. ..... 426/129; 206/45.14; 206/45.33; 206/476; 206/562; 229/35; 229/87 F

[58] Field of Search ..... 229/35, 36, 87 F; 206/45.33, 485, 562, 563, 476, 486, 299, 45.14; 426/129, 124, 396

[56] References Cited

U.S. PATENT DOCUMENTS

| | | | |
|---|---|---|---|
| T896,016 | 3/1972 | Harris . | |
| 1,987,491 | 1/1935 | Nejelski . | |
| 2,072,753 | 3/1937 | Ikeda et al. | 229/36 |
| 2,442,980 | 6/1948 | Lewis, Jr. | 206/45.14 X |
| 2,536,639 | 1/1951 | Guyer . | |
| 2,583,927 | 1/1952 | Bianchi | 206/45.19 |
| 2,638,210 | 5/1953 | Sparks | 206/45.14 |
| 2,660,364 | 11/1953 | Ferguson | 229/35 |
| 2,750,100 | 6/1956 | Greisman | 229/31 |
| 2,959,339 | 11/1960 | Sierk et al. | 426/129 X |
| 3,316,102 | 4/1967 | Doll et al. . | |
| 3,521,741 | 7/1970 | Beaudry | 206/45.14 |
| 3,608,811 | 9/1971 | Frick | 229/31 R |
| 3,623,650 | 11/1971 | Watts | 229/31 R |
| 3,734,275 | 5/1973 | Greene | 206/45.31 |

FOREIGN PATENT DOCUMENTS

| | | | |
|---|---|---|---|
| 1347175 | 11/1963 | France | 206/485 |
| 1397854 | 3/1965 | France | 229/87 F |
| 879501 | 10/1961 | United Kingdom | 426/396 |

*Primary Examiner*—Stephen P. Garbe
*Attorney, Agent, or Firm*—Stephen P. Gilbert

[57] ABSTRACT

A tray for shipping and displaying dressed poultry for sale is disclosed. The rear end wall of the tray forms an acute angle with the tray bottom and contains an aperture through which the ends of the legs of the poultry are inserted so as to prevent hocking (spreading of the legs). Preferably, a sunburst die pattern is cut around the aperture. The sunburst fingers prevent the legs from pulling away from the rear walls and lock the fowl in place. Also, preferably, a tail shield folds down from the top of the rear wall to cover the ends of the legs extending through the aperture. This prevents the legs from puncturing the plastic overwrap on the tray.

24 Claims, 12 Drawing Figures

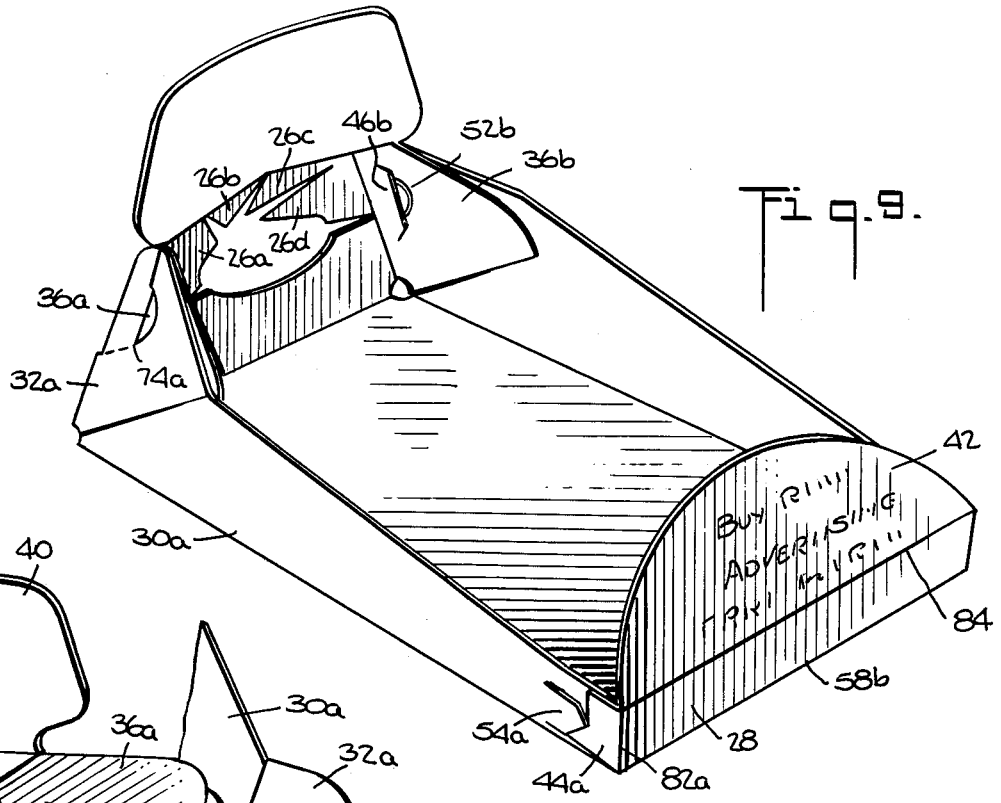
Fig. 9.
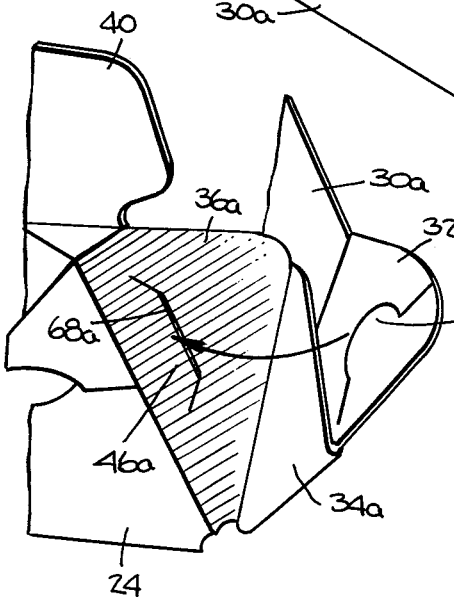
Fig. 8.
Fig 10.
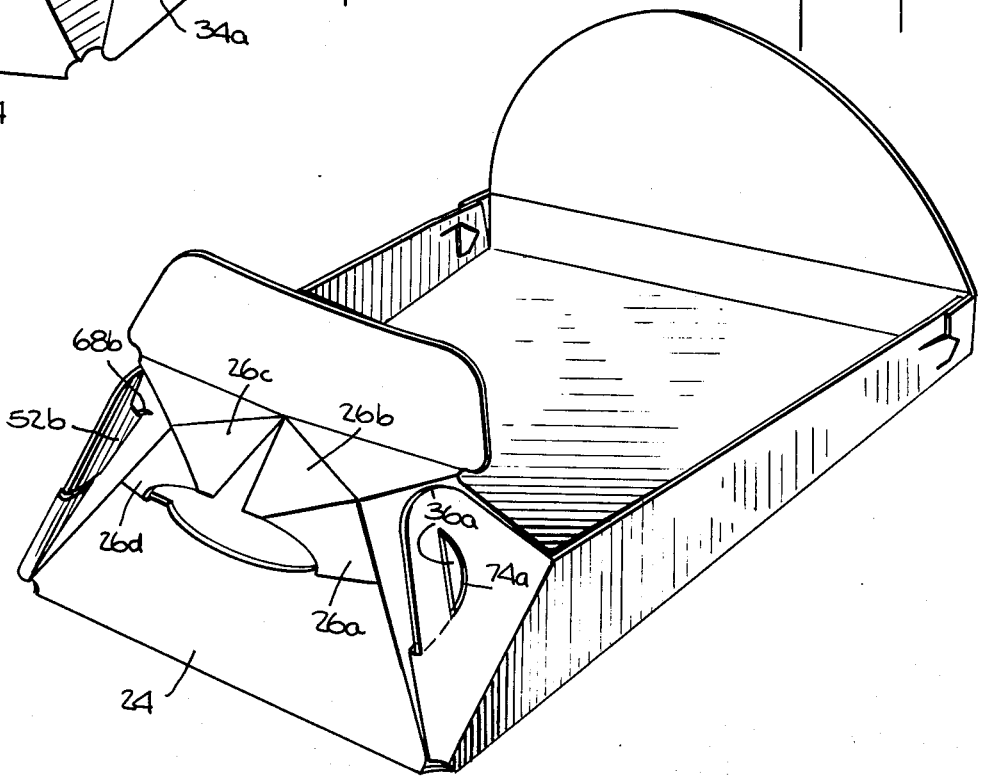

POULTRY TRAY

BACKGROUND OF THE INVENTION

This invention relates to poultry trays and blanks therefor. The principal types of packaging currently used to display dressed fowl for sale are the styrofoam tray and the Poly bag. Dressed fowl may be placed on a styrofoam tray and the fowl and tray overwrapped (totally or partially encased with a clear plastic wrapping). Unfortunately, however, poultry so packaged has a tendency to shift within the tray and hocking (spreading of the legs) occurs. Hocking is aesthetically objectionable to the consumer and may cause puncture of the overwrap, which, in turn, may lead to contamination. Additionally, because the overwrap conforms to the shape of the chicken, printing the overwrap, such as, with brand information, must be done before wrapping. This requires printing on a plastic film and registering the printed information to the poultry when wrapping. These are difficult and expensive. Finally, a large number of different size styrofoam trays must be available to accommodate the range of poultry sizes.

The Poly bag is a polyethylene bag for containing poultry. Since the bag is not totally transparent, it hinders the consumer's view of the fowl. Furthermore, the bag tends to wrinkle, thus printing on it is difficult to read. Finally, because the bag generally conforms to the shape of the poultry, there can be no stacking orientation. Thus, shipping and display are made more difficult.

Defensive Publication No. T896,016 (Mar. 7, 1972) discloses an overwrapped food package, which, according to FIG. 3, can contain poultry. The package comprises a styrene-thermoplastic tray overwrapped with a polymeric film. The drawings show the tray to be of standard shape, like the styrofoam tray. No means are shown for preventing hocking or puncture by the legs of the poultry.

U.S. Pat. No. 2,536,639 discloses a poultry tray having inwardly-folding flaps that "engage against the legs of the bird in such a manner as to hold the legs in proper relation" (column 1, lines 50 to 52). However, it is apparent that the patent is not concerned with preventing puncture of the overwrap by the ends of the legs because the overwrap is optional and no means of shielding the overwrap from the ends of the legs is disclosed. Additionally, the tray is for display purposes only (column 1, lines 1 to 4), not for shipping.

U.S. Pat. No. 1,987,491 discloses an opaque container for dressed fowl, which container has a transparent window at the top for viewing. The legs of the fowl are contained within the narrower end of the package. There is nothing, however, to prevent shifting of the fowl within the box and, thus, a different size box must be provided for each size of fowl.

SUMMARY OF THE INVENTION

Broadly, the poultry tray of the present invention comprises a bottom panel and an end wall having an aperture through which the ends of the legs of the fowl are passed, whereby the legs are held together and in place. The bottom panel and rear end wall are hingedly connected and, when the tray is erected, form an acute angle. In one embodiment the tray further comprises a sunburst die pattern cut in the rear wall and an inwardly folding front end wall. The fingers formed by the sunburst pattern and the front wall aid in holding the fowl in place, thus allowing the same size tray to be used for a range of poultry sizes.

In another embodiment a tail shield is attached to the top of the rear end wall. Preferably, this panel folds outwardly down so as to shield the ends of the legs of the poultry, thereby preventing them from puncturing the overwrap.

In another embodiment the tray comprises a bottom panel, a rear end wall having an aperture for the legs of the poultry, an inwardly folding front end wall, and a tail shield connected to the top of the rear wall. In all embodiments side walls and means for locking the end wall or walls to the side walls may be present.

The tray of this invention holds the poultry in position within the tray, prevents movement of the leg ends (including hocking) and one tray size accommodates a range of poultry sizes. The preferred tail shield prevents the leg ends from puncturing the overwrap. The new tray has a large natural bottom for displaying a substantial amount of information, such as, recipes and the new UPC (Universal Product Code) symbols. Additionally, the tray has a large top area (the tail shield and an optional display panel connected to the front end wall) for information, such as, brand identification and weight and price data. The tray may be placed on its front end, with the tail shield on top, thus displaying weight and price data printed thereon and saving room on a display shelf. Finally, the new tray provides a maximum of product viewing area for the consumer.

BRIEF DESCRIPTION OF THE DRAWINGS

To aid in understanding the invention, the accompanying drawings are provided in which:

FIGS. 6, 7, and 8 shows the steps in erecting the tray of FIG. 1 from the blank of FIG. 4;

FIGS. 9 and 10 are, respectively, front and rear perspective views of the erected tray;

FIG. 12 shows the preferred machine-set blank of this invention.

Figures 2, 3, 11:
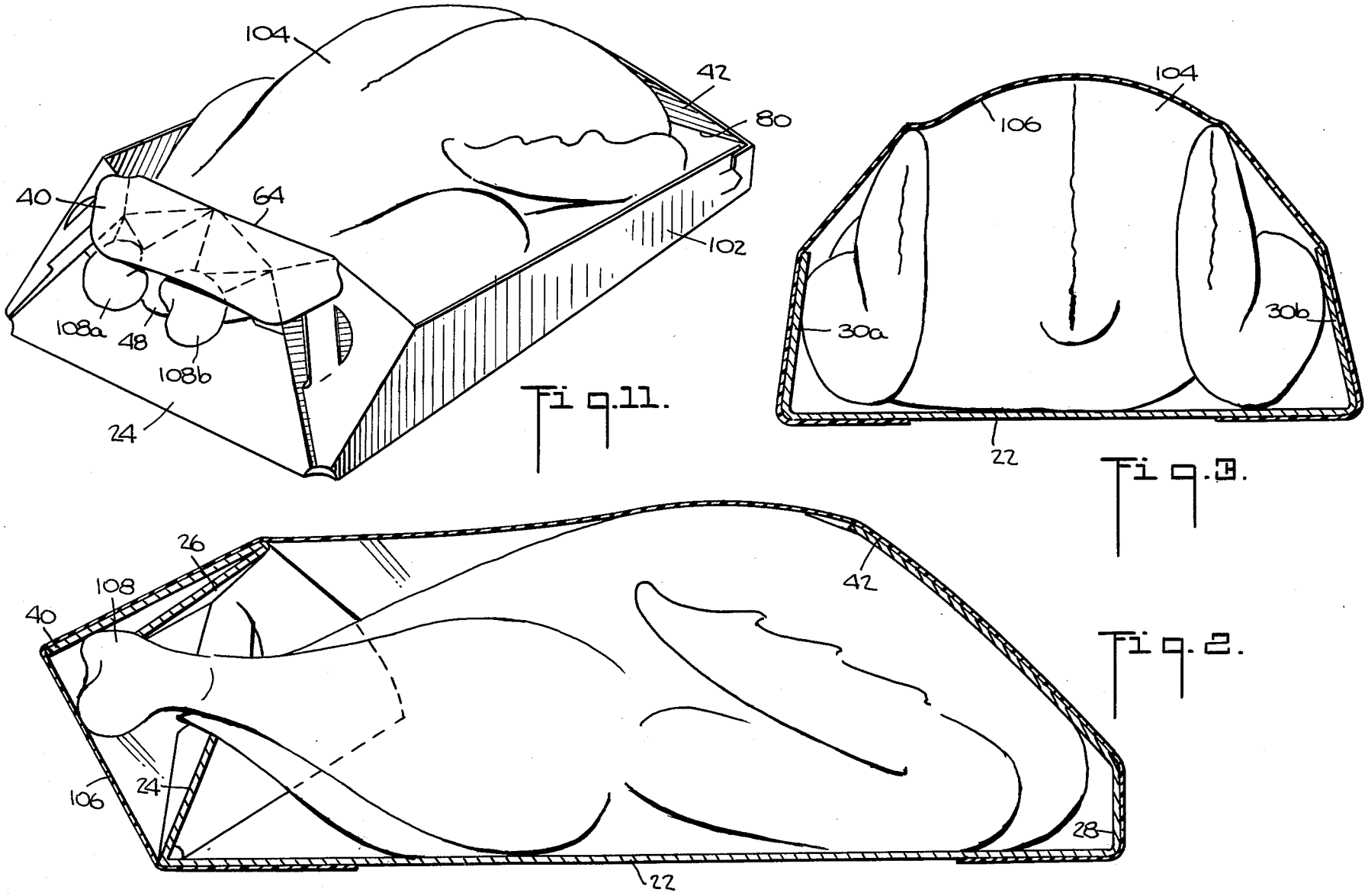
FIG. 2 is a side view of FIG. 1 taken along line 2—2.
FIG. 3 is an end view of FIG. 1 taken along line 3—3.
FIG. 11 shows dressed fowl in the tray before overwrapping.

It should be noted that these drawings are for illustrative purposes only and should not be construed to limit the claims.

DETAILED DESCRIPTION OF THE INVENTION

Broadly, the blank and tray of this invention comprise a bottom panel and a rear panel. Various other panels may be included. The panels are hingedly connected to one another by means of score lines (e.g., crease score, cut score, or skip-score lines) at the connecting edges of the panels. Generally, crease score lines are used. Folding of the blank occurs along these score lines.

The rear end wall of the tray contains an aperture through which the legs of the fowl are inserted. The aperture is not necessarily visible, though, before such insertion. For example, if the ends of sunburst die fingers 26*a, b, c,* and *d* in FIG. 4 were extended and met at a common point, the aperture would not, strictly speaking, be visible because it would be covered by the ends of the fingers. However, for the sake of simplicity, and blank or tray constructed so that the legs of the fowl may be inserted through its rear wall will be referred to as having an aperture.

After erection, the various panels extending upwards from the bottom panel are maintained in the desired position by being locked together. Locking means that may be used include fasteners, such as, staples, and locking tabs. Locking tabs are preferred and numerous types are known in the art. Generally, the method of locking the panels together is not important so long as it does not interfere with the function or ruin the appearance of the tray.

Any material may be used for the blank provided it can be folded, is sanitary, and will maintain the desired structural rigidity. Desirably, the material used is inexpensive and can be machined and printed upon easily. Preferably, paper products are used, especially folding carton board.

To hinder water and grease penetration and the resultant loss of structural rigidity or appearance or both, the tray material will generally be coated. Coatings that may be used include wax and polyethylene, of which the latter is preferred. Coatings are usually placed on both sides of the blank material but the inside surface alone may be coated.

One- to 15-pound and, usually, 2- to 12-pound birds may be held in the new trays. However, it is a feature of this invention that only a few tray sizes are needed to accommodate the full range of poultry sizes. For example, the blank shown in FIG. 5 (described below) will satisfactorily contain chickens ranging from 1.5 to 3 pounds.

The thickness of the tray material varies with the nature of the material and the size of the poultry contained therein, larger sizes and less rigid materials requiring greater thicknesses. A polyethylene-coated folding carton board having a thickness of 0.026 inches is suitable for the three-pound tray (blank shown in FIG. 5).

Methods of forming blanks and of forming trays from blanks are known in the art. The *Cutting And Creasing Manual* by Ralph E. Lutz, copyright 1956, discloses such methods and is hereby incorporated by reference. These methods may readily be used to form the tray and blank of this invention.

After erecting the tray, the dressed fowl is placed therein with the legs inserted through the aperture in the rear wall and the bird and tray overwrapped by machine or hand.

The overwrap may be of any transparent material, provided it possess the desired strength and puncture-resistance. Preferably, a stretch film is used. The overwrap is used not only for sanitary reasons, but to aid in forcing the dressed fowl towards the rear wall, which helps keep the leg ends (and the fowl) in position.

Figure 1:
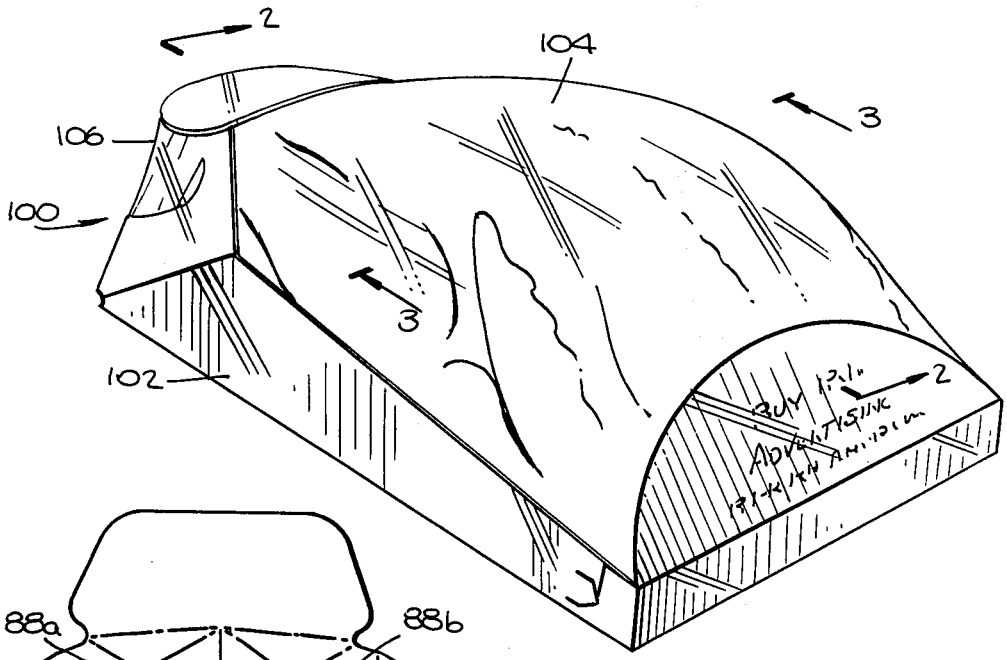
FIG. 1 shows the overwrapped poultry tray of this invention containing dressed fowl (chicken)
Figure 2:
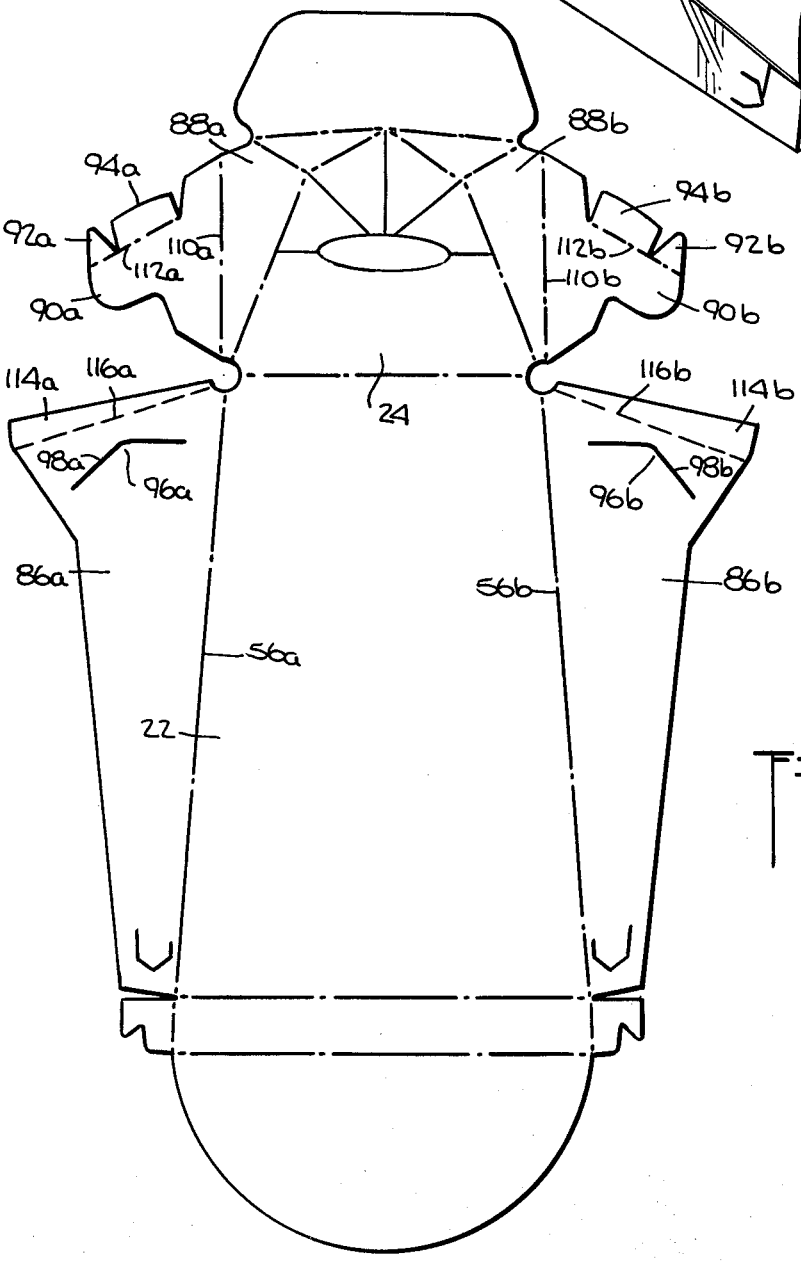

Turning now to the drawings, FIG. 1 illustrated package 100 as it would appear in a store. Dressed fowl 104 rests within poultry tray 102 and the combination is covered by overwrap 106.

FIG. 2 is a side view of package 100 taken along line 2—2 of FIG. 1. Poultry legs 108 extend through the aperture in rear wall 24. Sunburst die fingers 26, which are part of rear wall 24, lock leg ends 108, and thus the fowl, in place. Overwrap 106 pushes display panel 43 against the body of the fowl and front wall 28 against the neck (not shown). This, in turn, pushes the fowl towards rear wall 24. Front wall 28 may form an acute angle with bottom panel 22 but, preferably, is perpendicular to it.

Additionaly, overwrap 106 presses outwardly folded tail shield 40 against leg ends 108 and protects the overwrap from puncture by the leg ends. Preferably, tail shield 40 extends back far enough to prevent any substantial contact between leg ends 108 and overwrap 106. Tail shield 40 may be shorter, and allow more contact between leg ends 108 and overwrap 106, if the chances of such puncture are minimal (for example, if the leg ends are sufficiently smooth or if the overwrap is extremely puncture-resistant). Weight, price, brand identification, and the like may be displayed on top of tail shield 40 and display panel 42.

Although not shown in the drawings, preferably, a "diaper", usually of paper, is placed under the fowl near the front wall to absorb fluids, such as, blood, from the dressed fowl.

FIG. 3 is an end view of package 100 taken along line 3—3 of FIG. 1. Dressed fowl 104 rests on bottom panel 22 and between side panels 30. (It will be understood that reference numerals that are identical except for the alphabetic portion may be collectively referred to by the numeric portion. For example, left side panel 30*a* and right side panel 30*b* may be referred to as side panels 30.)

Figure 4:
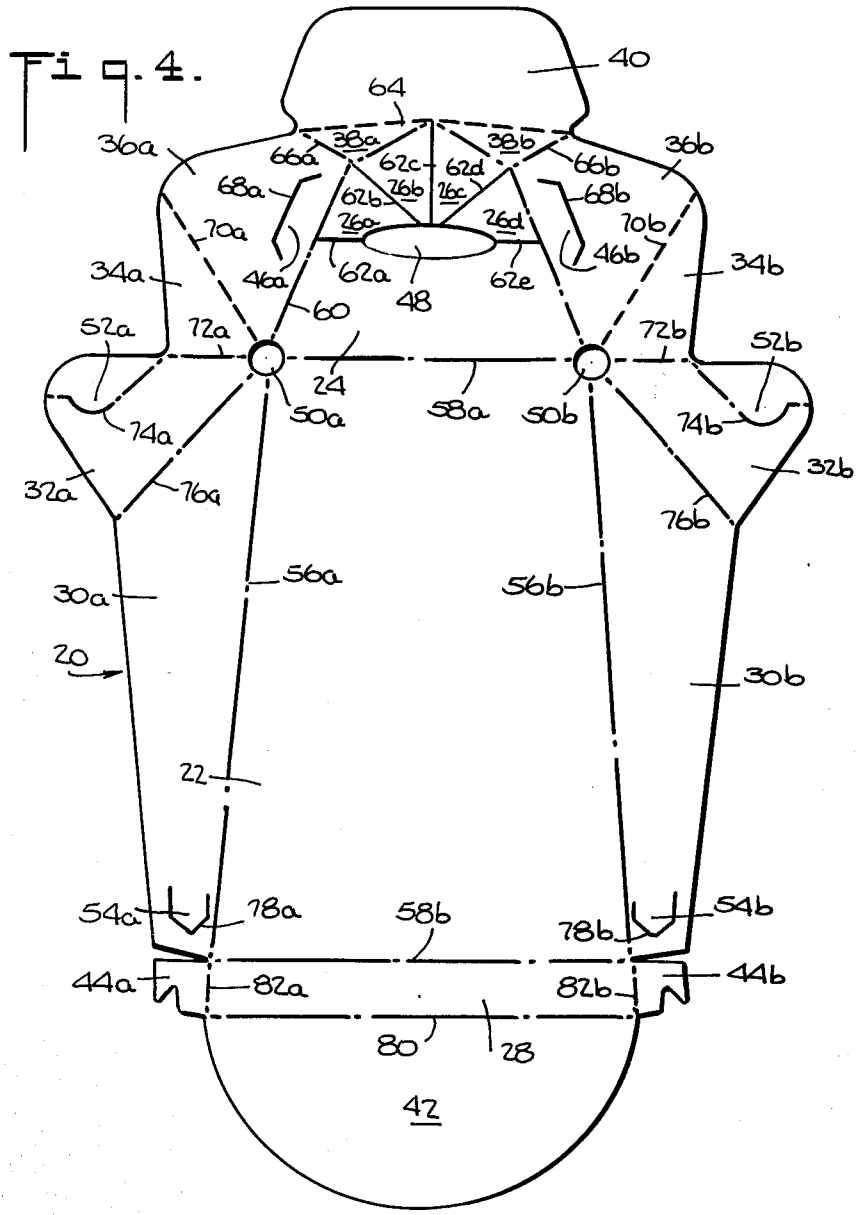
FIG. 4 shows the preferred hand-set (hand-erected) blank of this invention, which, when erected, forms the tray of FIG. 1.

FIG. 4 shows the peferred hand-set blank for forming the tray of FIG. 1. The blank comprises various panels defined by score lines. Bottom panel 22 is bounded by end score lines 58 and side score lines 56. Rear panel 24 is bounded by U-shaped score line 60 and score line 58*a*. Front end wall 28 is defined by score lines 80, 82, and 58*b*. Front end display panel 42 joins wall 28 at score line 80.

Left side wall 30*a* and right side wall 30*b* meet bottom panel 22 at score lines 56*a* and 56*b*, respectively. Side panels 30 contain female locks 54 defined by cut lines 78. Male corner locks 44, joined to front end wall 28 at score lines 82, function with female locks 54 upon erection of the tray, as described below.

Side panels 30 contain minor side panels 32 joined at score lines 76 and within panels 32, male tabs 52 are defined by cut lines 74. Infold gusset panels 34 are defined by score lines 72 and 70. Panels 36 are bounded by score lines 70, 60, and 66. Minor rear panels 38 are defined by score lines 66, 64, and 60. Tail shield 40 connects with minor panels 38 at score line 64. Female slots 46 in panels 36 are defined by cut lines 68 and after set-up, male tabs 52 and female slots 46 coact to join the rear section of the tray to the side sections.

Rear end wall 24 contains sunburst fingers 26 and aperture 48. The sunburst fingers 26 are roughly triangular in shape and are defined by cut lines 62 on two sides and are hingedly connected to the rest of the blank at score line 60. Because of practical limitations on the manufacture of dies, small circular cut-outs 50 are made where score lines 56, 58*a*, 60, 70, 72, and 76 would meet if the cut-outs were not present.

Figure 5:
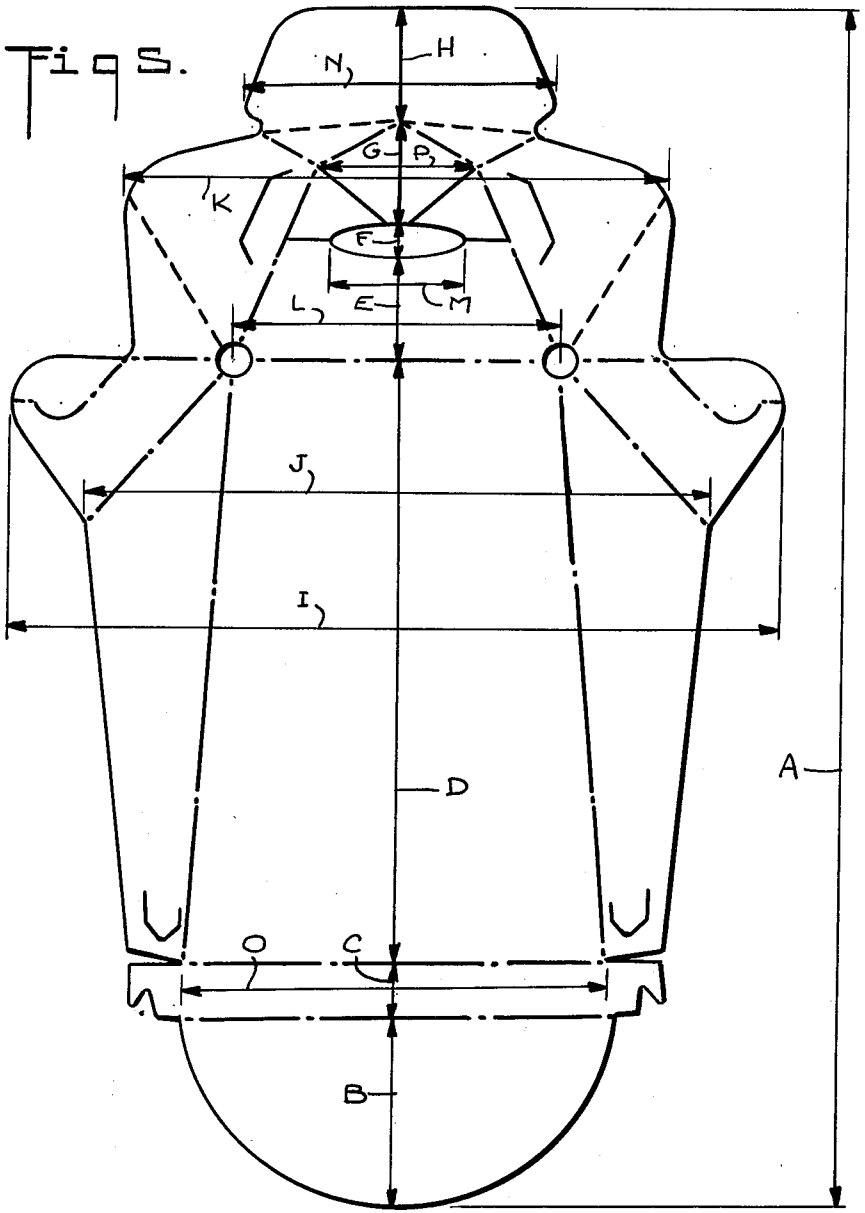
FIG. 5 indicates the dimensions of the blank of FIG. 4.

FIG. 5 indicates dimension lines for the preferred hand-set blank. A blank large enough to hold a chicken of from 1.5 to 3 pounds has the following dimensions:

| Dimension Line | Length (inches) |
|---|---|
| A | 16⅛ |
| B | 2½ |
| C | ⋮ |
| D | 8⅛ |
| E | 1⅜ |
| F | ½ |
| G | 1⅜ |
| H | 1½ |
| I | 10⅛ |
| J | 8¼ |
| K | 7⅜ |
| L | 4¼ |
| M | 1⅜ |
| N | 4 |
| O | 5½ |
| P | 2⅛ |

Figure 6:
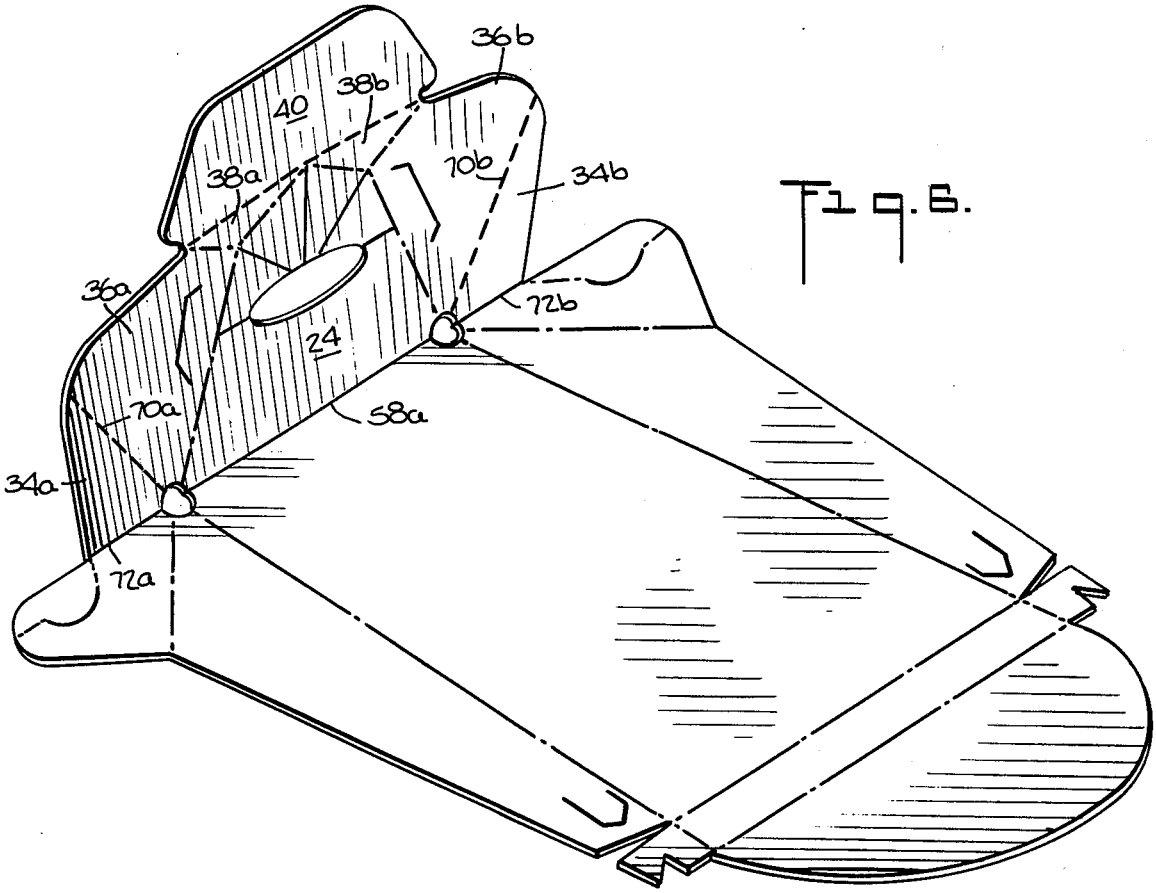

FIG. 6 shows the first step in transforming the blank of FIG. 4 into the tray of FIG. 1. The rear section, comprising panels 34, panels 36, panels 38, panel 24, and panel 40, is folded up as a unit along score lines 72*a*, 58*a*, and 72*b*.

Figure 7:
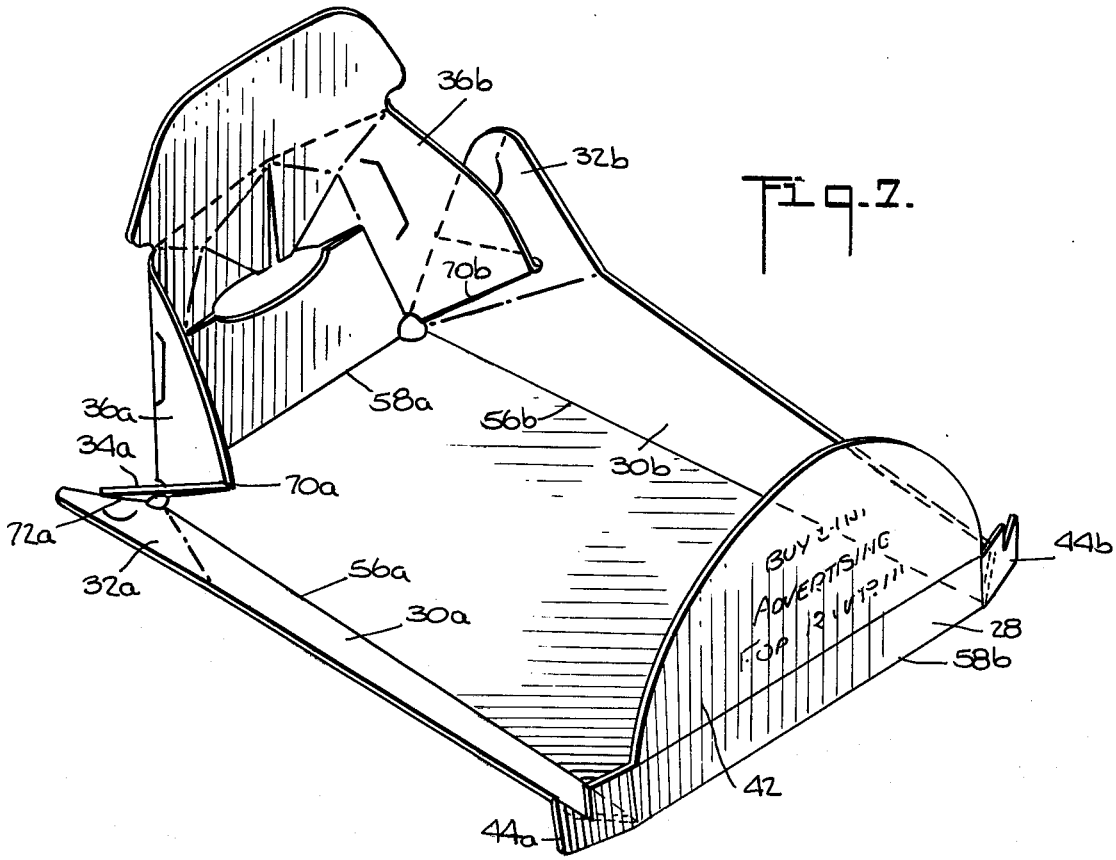

FIG. 7 shows panel 34*a* and part of 36*a* moved inwards by bending along score line 70*a*. Panels 34*b* and 36*b* are similarly manipulated. As crease line 70*a* moves inward, panel 34*a* moves towards panel 32*a* due to folding along line 72*a*, and similarly with respect to panels 32*b* and 34*b*. As a result, side panels 30 rotate upward along score lines 56. FIG. 7 also shows panels 28, 42, and 44 rotated as a unit upwards along score line 58*b*.

FIG. 8 is a partial, outer view of a rear corner of the tray following the steps of FIG. 7. Panel 32*a* is brought into contact with panel 36*a* and male tab 52*a* is inserted into female slot 46*a* at cut line 68*a*. Male tab 52*b* is similarly inserted into female slot 46*b* at cut line 68*b*. This locks the rear wall to the erect side walls. Note that panels 36 are curved (or rounded) following this step. This provides tension to maintain the lock.

FIG. 9 shows that after the rear wall is connected to the side walls, sunburst die fingers 26 spread apart slightly and move away from the bottom portion of rear end wall 24. Additionally, FIG. 9 shows male corner lock 44*a* folded towards side wall 30*a* along crease line 82*a* and inserted under female lock 54*a*. Male corner lock 44*b* is similarly folded and inserted into female lock 54*b* (not shown).

FIG. 10 is a rear perspective view of the erected tray, which shows male tab 52*b* inserted through cut line 68*b*. Additionally, a small portion of panel 36*a* is visible through cut line 74*a*.

FIG. 11 shows a chicken placed in the erected tray. Leg ends 108 are inserted through aperture 48 and the sunburst die fingers are pushed out only as much as is necessary to allow insertion. Outward movement of the fingers enlarges aperture 48. The combination of minimal folding of the fingers (due to their minimal outward movement) and sufficient rigidity of the tray material causes the fingers to maintain constant bias of the legs against the bottom of aperture 48.

An important feature of the erected tray is that rear wall 24 forms an acute angle with bottom panel 22. Generally this angle will be from 45 to 85 degrees and, preferably, from 55 to 75 degrees. (A tray erected from the blank of FIG. 5 has an angle of 66.5 degrees.) Because of the acute angle, the legs of the chicken can easily push the sunburst die fingers out; however, the acute angle and the contact between the legs and the ends of the sunburst fingers make it more difficult to remove the leg ends. This helps secure the chicken to the rear wall and allows one size tray to be used for a range of chicken sizes. Furthermore, the fingers help keep the legs together, i.e., prevent hocking.

Additionally, FIG. 11 shows tail flap 40 outwardly folded down onto leg ends 108 along score line 64 and also shows display panel 42 folded down onto chicken 104 along score line 80. When overwrapped, panel 42 and front wall 28 push the chicken towards rear panel 24, helping secure the fowl within the tray and allowing one tray to be used for a range of bird sizes.

FIG. 12 shows the preferred machine-set blank. The major difference between this blank and the preferred hand-set blank is in the means for locking the rear wall to the side walls. These differences are described below.

Side walls 86 are attached to bottom panel 22 at crease lines 56. Each side panel 86 contains a female lock 96 formed by cut line 98 and a score line 116 defining a smaller panel 114. Rear end wall 24 is attached to panels 88, which, in turn, are attached to panels 90. Score lines 110 separate panels 88 and 90. Male tabs 92 and 94 are joined to panels 90 by score lines 112.

To erect this blank, side walls 86 and rear wall 24 are folded upwards, and panels 90 are folded inward so as to contact the outer sides of side panels 86. Male tabs 92 and 94 are then inserted into female locks 96 through cut lines 98 and tabs 92 and 94 folded down.

As is obvious, if the rear wall forms an acute angle with the bottom panel, a machine to erect the blank of FIG. 12 must have a retractable mandrel that moves away from the inside of rear wall 24 after erection, otherwise the mandrel will catch the top of wall 24 when the mandrel is retracted vertically. If the blank of FIG. 12 is to be erected with a machine having a non-retractable mandrel, only male tabs 92 are pushed through cut lines 98 by the machine. At this point the rear wall is perpendicular to the bottom panel and will not interfere with vertical retraction of the mandrel. The tray is then discharged from the machine and the last step, pushing rear wall 24 toward bottom panel 22 so as to insert male tabs 94 through cut lines 98, is done manually. In either case (machine erection or machine-manual erection), score lines 116 lie inside of and directly next to score lines 110.

It is obvious that many modifications may be made in the blank and tray described above. For example, almost any locking means may be used for securing the rear end wall to the side walls and for securing the front end wall, if used, to the side walls. The tray may be erected manually, by machine, or by a combination thereof. The exact size and shape of the various panels may be altered so long as the functioning and appearance of the tray are not adversely affected. Furthermore, the shape of the aperture is not important nor is the number of sunburst fingers, if a sunburst pattern is used at all. In view of this, the following claims are intended to cover all modifications and variations as fall within the true scope and spirit of this invention.

I claim:

1. A blank for a poultry tray comprising:

(a) a bottom panel having first and second end edges and first and second side edges;

(b) a rear end wall having an aperture and first and second connecting edges, said first connecting edge being hingedly connected to the first end edge of the bottom panel;

(c) a tail shield hingedly conneted to the second connecting edge of the rear end wall;
(d) a side wall hingedly connected to one of the side edges of the bottom panel; and
(e) means for locking the rear end wall to the side wall at an acute angle to the bottom panel.

2. The blank of claim 1 wherein the rear end wall contains a sunburst die pattern.

3. A blank for a poultry tray comprising:
(a) a bottom panel having first and second end edges and first and second side edges;
(b) a rear end wall having an aperture and first and second connecting edges, said first connecting edge being hingedly connected to the first end edge of the bottom panel;
(c) a front end wall having first and second connecting edges, said first connecting edge being hingedly connected to the second end edge of the bottom panel;
(d) a tail shield hingedly connected to the second connecting edge of the rear end wall;
(e) a side wall hingedly connected to one of the side edges of the bottom panel;
(f) means for locking the rear end wall to the side wall at an acute angle to the bottom panel; and
(g) means for locking the front end wall to the side wall.

4. The blank of claim 3 wherein the rear end wall contains a sunburst die pattern.

5. A poultry tray comprising:
(a) a bottom panel having first and second end edges and first and second side edges;
(b) a side wall upwardly extending from and hingedly connected to one of the side edges of the bottom panel; and
(c) a rear panel hingedly connected to said first end edge, upwardly extending from the bottom panel, containing a sunburst die pattern, and locked to the side wall at an acute angle to the bottom panel.

6. The poultry tray of claim 5 containing a dressed fowl wherein the leg ends of the fowl project through the aperture in the rear end wall formed by the sunburst die pattern.

7. The poultry tray of claim 5 further comprising a front end wall having first and second connecting edges, said first connecting edge being hingedly connected to the second end edge of the bottom panel and said front end wall upwardly extending from the bottom panel.

8. The poultry tray of claim 7 containing a dressed fowl wherein the leg ends of the fowl project through the aperture in the rear end wall formed by the sunburst die pattern.

9. A poultry tray comprising:
(a) a bottom panel having first and second end edges and first and second side edges;
(b) a side wall upwardly extending from and hingedly connected to one of the side edges of the bottom panel;
(c) a rear end wall having an aperture and first and second connecting edges, the first connecting edge being hingedly connected to the first end of the bottom panel and said rear end wall upwardly extending from the bottom panel and being locked to the side wall at an acute angle to the bottom panel; and
(d) a tail shield hingedly connected to the second connecting edge of the rear end wall.

10. The poultry tray of claim 9 containing a dressed fowl wherein the leg ends of the fowl project through the aperture in the rear end wall.

11. The poultry tray of claim 9 wherein the rear end wall contains a sunburst die pattern.

12. The poultry tray of claim 11 containing a dressed fowl wherein the leg ends of the fowl project through the aperture in the rear end wall.

13. A poultry tray comprising:
(a) a bottom panel having first and second end edges and first and second side edges;
(b) a first side wall upwardly extending from and hingedly connected to the first side edge of the bottom panel;
(c) a rear end wall having an aperture and first and second connecting edges, the first connecting edge being hingedly connected to the first end edge of the bottom panel and said rear end wall upwardly extending from the bottom panel and being locked to the side wall at an acute angle to the bottom panel;
(d) a front end wall having first and second connecting edges, said first connecting edge being hingedly connected to the second end edge of the bottom panel and the front end wall upwardly extending therefrom and being locked to the side wall; and
(e) a tail shield hingedly connected to the second connecting edge of the rear end wall.

14. The poultry tray of claim 13 containing a dressed fowl wherein the leg ends of the fowl project through the aperture in the rear end wall.

15. The poultry tray of claim 13 wherein the rear end wall contains a sunburst die pattern.

16. The poultry tray of claim 15 containing a dressed fowl wherein the leg ends of the fowl project through the aperture in the rear end wall.

17. The poultry tray of claim 13 further comprising a display panel hingedly connected to the second connecting edge of the front end wall.

18. The poultry tray of claim 17 containing a dressed fowl wherein the leg ends of the fowl project through the aperture in the rear end wall.

19. The poultry tray of claim 13 further comprising a second side wall upwardly extending from and hingedly connected to the second side edge of the bottom panel wherein the rear end wall and the front end wall are locked to the two side walls.

20. The poultry tray of claim 19 containing a dressed fowl wherein the leg ends of the fowl project through the aperture in the rear end wall.

21. The poultry tray of claim 19 wherein the rear end wall contains a sunburst die pattern.

22. The poultry tray of claim 21 containing a dressed fowl wherein the leg ends of the fowl project through the aperture in the rear end wall.

23. The poultry tray of claim 21 further comprising a display panel hingedly connected to the second connecting edge of the front end wall.

24. The poultry tray of claim 22 containing a dressed fowl wherein the leg ends of the fowl project through the aperture in the rear end wall.

* * * * *

UNITED STATES PATENT AND TRADEMARK OFFICE

CERTIFICATE OF CORRECTION

PATENT NO. : 4,173,655

DATED : November 6, 1979

INVENTOR(S) : James L. Capo

It is certified that error appears in the above-identified patent and that said Letters Patent are hereby corrected as shown below:

In col. 3, line 5: "and" should be --any--.

In col. 3, line 61: "illustrated" should be --illustrates--.

In col. 4, line 1: "43 should be --42--.

In col. 4, line 7: "Additionaly" should be --Additionally--.

In col. 4, line 32: "peferred" should be --preferred--.

In col. 5, line 5: After "C" insert --3/4--.

In claim 1, col. 7, line 1: "conneted" should be --connected--.

In claim 24, col. 8, line 63: "22" should be --23--.

Signed and Sealed this

*Twenty-ninth* Day of *April 1980*

[SEAL]

*Attest:*

SIDNEY A. DIAMOND

*Attesting Officer*

*Commissioner of Patents and Trademarks*